US007603979B2

(12) United States Patent
Tanimura et al.

(10) Patent No.: US 7,603,979 B2
(45) Date of Patent: Oct. 20, 2009

(54) VALVE UNIT FOR INTERNAL COMBUSTION ENGINE

(75) Inventors: Hiroshi Tanimura, Kariya (JP); Naoto Miyauchi, Obu (JP)

(73) Assignees: Denso Corporation, Kariya (JP); Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 12/353,505

(22) Filed: Jan. 14, 2009

(65) Prior Publication Data

US 2009/0178645 A1 Jul. 16, 2009

(30) Foreign Application Priority Data

Jan. 15, 2008 (JP) ..... 2008-006005

(51) Int. Cl.
*F02D 9/08* (2006.01)

(52) U.S. Cl. ..... 123/337

(58) Field of Classification Search ..... 123/337; 251/305

See application file for complete search history.

(56) References Cited

U.S. PATENT DOCUMENTS 5,704,335 A 1/1998 Akutagawa et al.
6,814,051 B2 11/2004 Suzuki
6,868,825 B2 * 3/2005 Suzuki ..... 123/337
7,047,935 B2 * 5/2006 Arai et al. ..... 123/337
7,069,902 B2 * 7/2006 Arai et al. ..... 123/337
7,107,679 B2 * 9/2006 Arai et al. ..... 29/888.4
7,107,683 B2 * 9/2006 Arai et al. ..... 29/888.4
7,328,507 B2 * 2/2008 Arai et al. ..... 29/888.4
2004/0187844 A1 * 9/2004 Torii et al. ..... 123/337

FOREIGN PATENT DOCUMENTS

JP 2002-221051 8/2002
JP 2005-290994 10/2005
JP 2006-097695 4/2006

* cited by examiner

*Primary Examiner*—Hai H Huynh
(74) *Attorney, Agent, or Firm*—Nixon & Vanderhye P.C.

(57) ABSTRACT

A valve unit for an internal combustion engine includes a duct, a valve and a shaft. The duct includes an inner tube defining a gas passage and an outer tube disposed radially outside of the inner tube. The duct has an annular liquid storage groove between the outer tube and the inner tube. The valve is supported by the shaft in the inner tube to control the gas passage The shaft is held by a bearing portion of the duct. The inner tube has an overflow portion and an overflow-restricting portion at an upper end. The overflow portion regulates a level of liquid stored in the storage groove and allows excess liquid to overflow from the storage groove. The overflow-restricting portion is provided in a predetermined area above the bearing portion and located higher than the overflow portion to restrict the liquid from overflowing from the predetermined area.

17 Claims, 6 Drawing Sheets

VALVE UNIT FOR INTERNAL COMBUSTION ENGINE

CROSS REFERENCE TO RELATED APPLICATION

This application is based on Japanese Patent Application No. 2008-6005 filed on Jan. 15, 2008, the disclosure of which is incorporated herein by reference.

FIELD OF THE INVENTION

The present invention relates to a valve unit for an internal combustion engine. More particularly, the present invention relates to a valve unit to be mounted in a vehicle such that a gas passage defined therein extends in an up and down direction of the vehicle.

BACKGROUND OF THE INVENTION

An intake unit, such as an electronic throttle device, has been conventionally known as an example of the valve unit. The electronic throttle device is adapted to control an operation of an electric motor in accordance with the amount of pushing operation of a gas pedal, thereby to control a throttle opening degree, which corresponds to a valve opening degree of a throttle valve, to a target value.

In such an electronic throttle device, a structure of restricting icing of the throttle valve and a shaft supporting the throttle valve has been proposed, for example, in JP-A-2005-290994, JP-B2-3787861 corresponding to U.S. Pat. No. 5,704,335, and JP-B2-4013249 corresponding to U.S. Pat. No. 6,814,051.

FIGS. 5 and 6 show an example of an electronic throttle device having the icing restricting structure. As shown in FIGS. 5 and 6, the throttle device has a throttle body providing a throttle bore 101 therein through which intake air flows. The throttle body has a double-tube structure including an inner tube 104 and an outer tube 105, and forms annular grooves 111, 112 between the inner tube 104 and the outer tube 105. The annular grooves 111, 112 can capture water content flowing from an upstream location or a downstream location of the throttle body with respect to a flow of the intake air along an inner surface of an intake air passage, thereby to restrict a throttle valve 102 and a shaft 103 supporting the throttle valve 102 from being iced due to the water content.

The throttle body has a separation wall 113 between the inner tube 104 and the outer tube 105 to separate the annular groove 111 from the annular groove 112. The throttle body has a first bearing portion 114 and a second bearing portion 115 to support a first end and a second end of the shaft 103, respectively. Further, a bearing, such as a ball bearing 116, is disposed between the second end of the shaft 103 and the second bearing portion 115.

The above structure is effective in a case where the throttle device is mounted in a vehicle in a side-draft manner such that an axis of the throttle bore 101 extends in a horizontal direction, which is perpendicular to an up and down direction of the vehicle. In this case, water is captured in the annular grooves 111, 112. The captured water is collected at the lowest locations in the annular grooves 111, 112. Further, in a case where the throttle device is mounted such that the shaft 103 extends in the horizontal direction, the water flowing over from the annular grooves 111, 112 can be drawn to combustion chambers of the engine via portions that are the furthest from the bearing portions 114, 115 of the throttle body.

In such a throttle device, if water is applied to the vicinities of the bearing portions 114, 115, the water is likely to enter clearances between the ends of the shaft 103 and the bearing portions 114, 115 and/or in the bearing 116 and permeate therein due to capillarity.

If an ambient temperature drops lower below freezing after the engine is stopped, the water is frozen in the clearances between the ends of the shaft 103 and the bearing portions 114, 115 and/or in the bearing 116, and thus the throttle valve 102 and the shaft 103 are iced. If the engine is started in the condition where the throttle valve 102 and the shaft 103 are iced, malfunctions, such as an inoperative condition of the valve 102 and a shaft lock, occur.

That is, the icing of the throttle valve 102 and the shaft 103 results in an occurrence of icing torque. When the electronic throttle device mounted in the side-draft manner, however, the occurrence of such icing can be reduced.

Also, it is proposed to mount the throttle device in a down-draft manner such that the intake air flows in a downward direction or in an up-draft manner such that the intake air flows in an upward direction. FIG. 7 shows an example of the throttle device mounted in the down-draft manner. The longitudinal axis of the throttle bore 101 extends in a vertical direction, such as in the up and down direction of the vehicle.

In the throttle device mounted in the down-draft or up-draft manner, water can be temporarily stored in the annular groove 111, which is open in an upward direction. However, it is uncertain from which position the water overflows in the top end of the inner tube 104 with respect to a circumferential direction. The water may reach a bearing portion 117 of the throttle body along an inner surface of the inner tube 104. In the example shown in FIG. 7, a bearing 119 is disposed between the shaft 103 and the bearing 117.

In the throttle device mounted in the down-draft or up-draft manner, it is further proposed to incline the annular groove 111 with respect to the horizontal direction of the vehicle, such as a vehicle front and rear direction or a vehicle right and left direction, as shown in FIG. 8. In this case, the water temporarily stored in the annular groove 111 can overflow from the annular groove 111 through the lowest position of the upper end of the inner tube 104. Such a throttle device is, for example, described in JP-A-2002-221051. In JP-A-2002-221051, it is proposed to form a notch (not shown) at the lowest position of the upper end of the inner tube 104 such that the water can be discharged from the annular groove 111 through the notch.

In the above throttle device, however, the upper end of the inner tube 104 is inclined, and the bottom of the annular groove 111 is also inclined. Therefore, the amount of water stored in the annular groove 111 is smaller than the amount of water stored in the annular groove 111 having a horizontal bottom as shown in FIG. 7. Also, it is necessary to care the position of the notch such that the notch is located at the lowest position in the upper end of the inner tube 104 when the throttle body is assembled.

SUMMARY OF THE INVENTION

The present invention is made in view of the foregoing matter, and it is an object of the present invention to provide a valve unit for an internal combustion engine, capable of reducing the entry of water into a bearing portion.

According to an aspect of the present invention, a valve unit for an internal combustion engine includes a duct, a valve, and a shaft. The duct includes an inner tube defining a gas passage therein and an outer tube disposed radially outside of the inner tube. The duct provides an annular liquid storage groove between the inner tube and the outer tube. The duct has a bearing portion for holding the shaft. The inner tube defines an axis in an up and down direction. The valve is supported by the shaft in the inner tube and is operable to control the gas passage The inner tube has an overflow portion and an overflow-restricting portion. The overflow portion is configured to regulate a level of liquid stored in the liquid storage groove and allows excess liquid to overflow from the liquid storage groove. The overflow-restricting portion is provided in a predetermined area above the bearing portion and is located higher than the overflow portion to restrict the liquid from overflowing from the predetermined area above the bearing portion.

Therefore, even when the valve unit is mounted in a vehicle in a down-draft manner or in an up-draft manner such that gas flows through the gas passage in a downward direction or in an upward direction, liquid can be stored in the annular liquid storage groove. Further, the excess liquid can overflow from the liquid storage groove through the overflow portion, which is located lower than the overflow-restricting portion. That is, it is less likely that the liquid will overflow from the predetermined area above the bearing portion Accordingly, the entry of overflowed liquid into the bearing portion is reduced, and icing of the valve and the shaft due to the overflowed liquid is reduced Furthermore, freezing and malfunction of the valve, an increase in icing torque and shaft lock due to the icing of the shaft and the valve are reduced.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EXEMPLARY EMBODIMENTS

Figure 1:
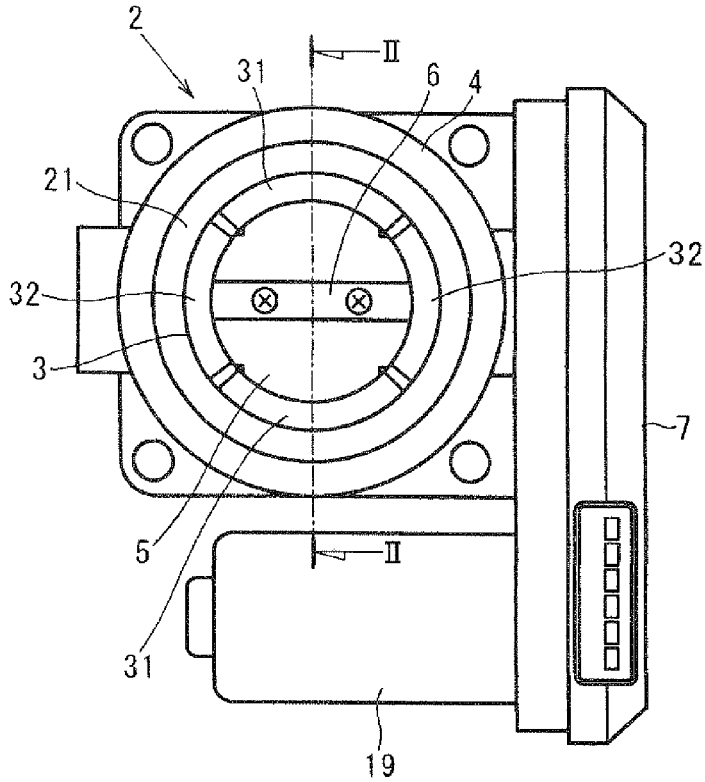
FIG. 1 is an end view of an electronic throttle device for an internal combustion engine according to a first embodiment of the present invention.

A first embodiment of the present invention will now be described with reference to FIGS. 1 and 2.

A valve unit of the present embodiment is, for example, an electronic throttle device mounted to an internal combustion engine, such as an engine mounted in an engine compartment of an automobile. For example, the engine is a gasoline engine that generates power, such as engine output shaft torque, engine torque, by thermal energy generated by combustion of mixture of intake air and fuel injected from injectors within combustion chambers. An air cleaner is generally mounted upstream of the engine, and thus clean intake air is introduced to the engine. The electronic throttle device is, for example, mounted in a down-draft manner or in an up-draft manner such that the intake air flows in a downward direction or in an upward direction.

The engine is provided with an intake duct for introducing the intake air (outside air) into the combustion chambers of engine cylinders and an exhaust duct for discharging exhaust gas from the combustion chambers to the outside of the vehicle through an exhaust emission control device. The intake duct (intake air path) forms an intake air passage for introducing clean intake air having passed through the air cleaner into a throttle body 2 of the electronic throttle device through an air cleaner hose 1. The intake duct includes an air cleaner case, the air cleaner hose 1, the throttle body 2, a surge tank, an intake manifold, and the like.

An engine body is constructed of a cylinder head, a cylinder block and the like. The cylinder head has intake ports on one side and exhaust ports on an opposite side. The intake ports are opened and closed by intake valves each having a poppet shape. The exhaust ports are opened and closed by exhaust valves each having a poppet shape. Spark plugs are fixed to the cylinder head such that ends thereof are exposed inside of the combustion chambers of the engine cylinders. Also, the injectors, such as electromagnetic fuel injection valves, are fixed to the cylinder heads for injecting fuel at optimum timings. Inside of cylinder bores formed in the cylinder block, pistons are provided. The pistons are supported by a crankshaft through connecting-rods to reciprocate in the cylinder bores.

The air cleaner is located at an upstream-most location of the intake duct. The air cleaner has a filter element for capturing impurities, such as dust and sand, contained in the outside air.

The air cleaner hose 1 serves as an intake pipe connecting the air cleaner and the throttle body 2. The air cleaner hose 1 has flexibility and is made of rubber-base elastic material, soft synthetic resin, or the like. The air cleaner hose 1 is air-tightly connected to a downstream end of the air cleaner case. Also, the air cleaner hose 1 is air-tightly fixed to an upstream end of the throttle body 2, such as an upper end of the throttle body 2. For example, the air cleaner hose 1 is fixed to the throttle body 2 by an air hose band 10. The air cleaner hose 1 forms an intake air passage 11 therein, upstream of a throttle valve 5 of the electronic throttle device.

The electronic throttle device generally includes the throttle body 2, which can be a duct and a housing, a throttle valve 5, a shaft 6, an actuator (valve driving device) and an engine control unit (hereinafter, ECU). The throttle body 2 has a double-tube structure, and is disposed in the intake duct. Specifically, the throttle body 2 is air-tightly connected to a downstream end of the air cleaner hose 1. The throttle valve 5 is, for example, a butterfly valve, and is operable to control a passage inside of the throttle body 2, such as an intake air flowing-in passage 12, first and second throttle bores 13, 14, and an intake air flowing-out passage 15. The throttle valve 5 is supported by the shaft 6. The actuator includes a motor for driving the throttle valve 5. The ECU controls electric power supplied to a coil of the motor in accordance with an operation condition of the engine and controls a throttle opening degree corresponding to a valve angle of the throttle valve 5 in association with other systems, such as an ignition device, a fuel injection device.

The electronic throttle device is an intake device of an internal combustion engine, which variably control a flow rate of the intake air, such as the volume of the intake air, to be introduced in the combustion chambers of the engine cylinders, thereby to control engine rotational speed or engine output shaft torque. The flow rate of the intake air to be introduced in the combustion chambers is controlled by varying the throttle opening degree. The throttle opening degree is varied by driving the motor in accordance with the degree of operation of a gas pedal of the vehicle. Here, the degree of operation of the gas pedal corresponds to the amount of pushing operation of the gas pedal by a driver.

The electronic throttle device further includes a return spring for biasing the throttle valve 5 in a valve-closing direction. The return spring is, for example, constructed of a coil spring.

In the present embodiment, the throttle body 2 has the double-tube structure, and includes an inner tube 3 defining the first and second throttle bores 13, 14 therein and an outer tube 4 disposed radially outside of the inner tube 3. The inner tube 3 has a cylindrical shape, and thus can be also referred to as an inside diameter cylindrical portion. The inner tube 3 has a circular cross-section. The outer tube 4 has a cylindrical shape and is disposed to surround a periphery of the inner tube 3 in a circumferential direction. The outer tube 4 can be also referred to as an outside diameter cylindrical portion.

The throttle body 2 is made of resin or metal and has a predetermined shape. The throttle body 2 is a housing supporting the throttle valve 5 therein to be rotatable between a fully closed position and a fully open position. The throttle body 2 is fixed to the surge tank or the intake manifold by bolts and the like.

The clean intake air having passed through the air cleaner flows through the intake air passage 11 and enters the throttle body 2 from an inlet opening, which is provided at the upper end of the throttle body 2. Inside of the throttle body 2, the clean intake air passes through the intake air flowing-in passage 12, the first and second throttle bores 13, 14 and the intake air flowing-out passage 15. A lower end of the throttle body 2, which defines an outlet opening of the throttle body 2, is connected to the surge tank, for example. Thus, the clean intake air flows out from the outlet opening of the throttle body 2 and further flows in the surge tank The clean intake air is then suctioned into the combustion chambers through the intake manifold and the intake air ports.

The throttle valve 5 is rotatably held in the inner tube 3. The inner tube 3 forms the down-flow throttle bores (intake air passages) 13, 14 having axes in the up and down direction of the vehicle. The first and second throttle bores 13, 14 extend straight from a first end to a second end of the inner tube 3. Here, the axes of the first and second throttle bores 13, 14, that is, an axis of the inner tube 3 is coincident with an axis of the throttle body 2, which extends in the up and down direction of the vehicle. The axes of the throttle bores 13, 14 are perpendicular to an axis of rotation of the throttle valve 5, that is, an axis of the shaft 6.

The first throttle bore 13 is in communication with the second throttle bore 14. The first throttle bore 13 is upstream of the second throttle bore 14 with respect to the flow of the intake air therein. The first throttle bore 13 defines the intake air passage upstream of the throttle valve 5. The second throttle bore 14 defines the intake air passage downstream of the throttle valve 5.

The outer tube 4 has an upper end located higher than the upper end of the inner tube 3. Also, the outer tube 4 has a lower end located lower than the lower end of the inner tube 3. That is, an axial dimension (length) of the outer tube 4 is greater than an axial dimension (length) of the inner tube 3. The outer tube 4 forms the intake air flowing-in passage 12 and the intake air flowing-out passage 15 therein. The intake air flowing-in passage 12 serves as a communication passage allowing communication between the intake air passage 11 of the air cleaner hose 1 and the first throttle bore 13 The intake air flowing-out passage 15 serves as a communication passage allowing communication between the second throttle bore 14 and an inside of the surge tank, such as an expansion chamber.

The intake air flowing-in passage 12 has an inner diameter (throttle bore diameter) greater than an inner diameter (throttle bore diameter) of the first and second throttle bores 13, 14. The intake air flowing-in passage 12 forms the inlet opening of the throttle body 2. The intake air flowing-in passage 12 is a passage for introducing the intake air into the first and second throttle bores 13, 14. The intake air flowing-in passage 12 is provided at the upper end of the throttle body 2.

The intake air flowing-out passage 15 has an inner diameter (throttle bore diameter) greater than inner diameter (throttle bore diameter) of the first and second throttle bores 13, 14. The intake air flowing-out passage 15 forms the outlet opening of the throttle body 2. The intake air flowing-out passage 15 is a passage for discharging the intake air from the first and second throttle bores 13, 14. The intake air flowing-out passage 15 is provided at the lower end of the throttle body 2.

Figure 2:
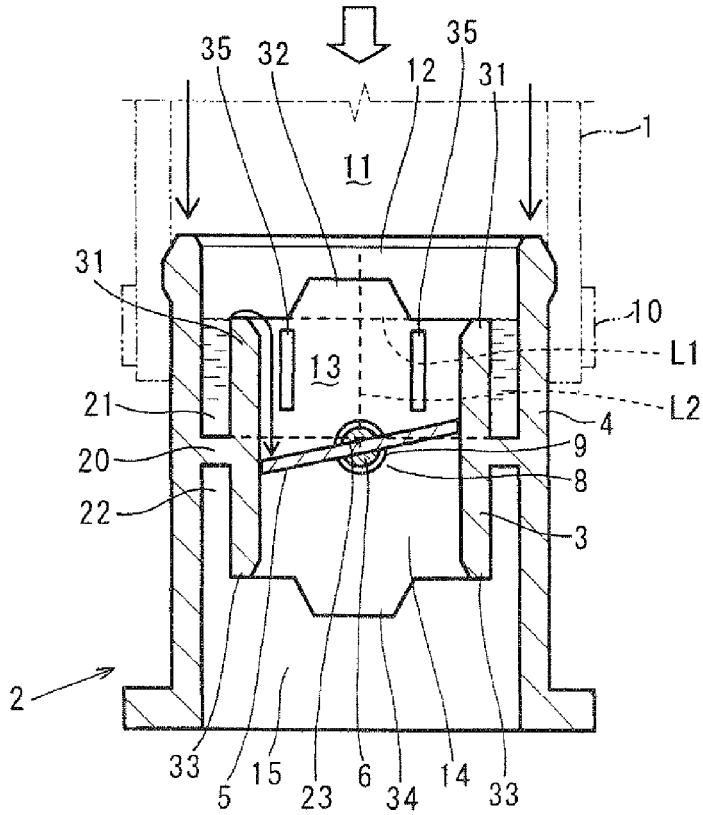
FIG. 2 is a cross-sectional view of a throttle body of the electronic throttle device taken along a line II-II in FIG. 1.

Referring to FIG. 1, the electronic throttle device has a sensor cover 7. For example, the sensor cover 7 is mounted to a side of the outer tube 4 with respect to an axial direction of the shaft 6, such as on a right side in FIG. 1. The sensor cover 7 holds a throttle opening degree sensor, which will be described later, therein. The sensor cover 7 is, for example, made of resin.

The throttle body 2 is provided with a pair of shaft bearing portions 8, which are opposed to each other across the throttle bores 13, 14. Each of the shaft bearing portions 8 forms a shaft-holding hole having a circular cross-section and extending in the axial direction of the shaft 6.

A bearing 9 is fitted in the shaft-holding hole of one of the shaft bearing portions 8 for supporting a first end of the shaft 6. Likewise, another bearing 9 is fitted in the shaft-holding hole of the other of the shaft bearing portions 8 for supporting a second end of the shaft 6.

That is, the shaft 6 is rotatably supported by the pair of shaft bearing portions 8 through the pair of bearings 9. The bearings 9 are, for example, sliding bearings. Alternatively, one of the bearings 9 can be the sliding bearing, and the other of the bearings 9 can be a rolling bearing or a ball bearing.

The electronic throttle device has a motor housing 19 for housing the motor therein. For example, the motor housing 19 is integrally formed with an outer wall of the outer tube 4 of the throttle body 2.

The throttle valve 5 is rotatably supported in the inner tube 3 for opening and closing the throttle bores 13, 14. That is, the throttle valve 5 is rotatable relative to the inner tube 3 of the throttle body 2. The throttle valve 5 is the intake air control valve capable of controlling the intake air passage. The throttle valve 5 is a circular butterfly valve movable about the axis of the shaft 6.

The throttle valve 5 is movable within a valve operation range between the fully closed position and the fully open position in accordance with a control signal from the ECU when the engine is in operation. That is, an opening area of the throttle bores 13, 14, that is, a passage area of the intake air passage is controlled by varying the position of the throttle valve 5, that is, a rotational angle of the throttle valve 5. As such, the flow rate of the intake air can be controlled.

When the electric power supply to the motor is ended due to the engine being stopped, the throttle valve 5 is returned to a predetermined position, such as the fully closed position or an intermediate position slightly opened from the fully closed position, by the biasing force of the return spring and the like.

The throttle valve 5 includes a circular plate portion extending from an intersection between the axis of the inner tube 3 and the axis of the shaft 6 as a center in a radial direction. At the fully closed position, the throttle valve 5 is positioned such that opposite surfaces of the circular plate portion of the throttle valve 5 are slightly inclined toward a valve opening direction at a predetermined angle relative to a perpendicular line, which is perpendicular to the axis of the inner tube 3.

The electronic throttle device is mounted in the vehicle such that the axis of the inner tube 3, that is, the axes of the throttle bores 13, 14 extend in the up and down direction of the vehicle, such as in a direction parallel to a direction of gravity.

The circular plate portion of the throttle valve 5 is inserted in a valve insertion hole 23 of the shaft 6, and is fixed to the shaft 6 by screws and the like in that condition. Thus, in this condition, the throttle valve 5 has a first semi-circular plate portion (first disc portion) and a second semi-circular plate portion (second disc portion) on opposite sides of the shaft 6 In the present embodiment, when the throttle valve 5 is at the fully closed position, the second semi-circular plate portion is located lower than the first semi-circular plate portion.

The shaft 6 extends straight in the axis of rotation thereof. The shaft 6 has a valve-holding portion at its center for holding the valve 5. The valve insertion hole 23 is formed in the valve holding portion. The valve insertion hole 23 is a through hole penetrating the valve-holding portion in a direction of diameter.

The shaft 6 is connected to an output shaft of the motor through a driving force transmitting device. The shaft 6 has sliding portions defining sliding surfaces at ends thereof. The sliding portions are rotatably supported in the shaft bearing portions 8 of the inner tube 3 through the bearings 9.

The actuator for driving the shaft 6, that is, the throttle valve 5 in the valve opening/closing direction is an electric actuator including the motor and the driving force transmitting device. The motor generates a driving force in response to the electric power supply. The driving force transmitting device transmits the driving force generated by the motor, that is, a rotational motion of the output shaft of the motor to the shaft 6.

The driving force transmitting device is constructed of a gear speed-reduction mechanism including a pinion gear (motor gear), an intermediate speed-reduction gear and a final speed-reduction gear. The pinion gear is fixed to the output shaft of the motor. The intermediate speed-reduction gear is rotated by engagement with the pinion gear. The final speed-reduction gear is rotated by engagement with the intermediate speed-reduction gear, The gear speed-reduction mechanism reduces the rotation speed of the motor at a predetermined reduction ratio, and increases the driving force (motor torque) of the motor. However, the output shaft of the motor can be directly connected to the shaft 6.

The motor is electrically connected to a battery of the vehicle through a motor driving circuit) which is electronically controlled by the ECU. The motor is housed in the motor housing 19, which is integrated with the outer tube 4 of the throttle body 2.

The ECU is provided with a microcomputer having a CPU executing various control processing and computations, memories, such as a ROM and a RAM, for storing various data, control programs and control logics, an input circuit (input device), an output circuit (output device), a power supply circuit, a timer and the like.

When an ignition switch (not shown) is turned on, the ECU controls the power supply to a coil of the motor for driving the shaft 6 of the throttle valve, the ignition device including the ignition coil and the spark plug, and the fuel injection device including an electric fuel pump and injectors, in accordance with the control program or the control logic stored in the memory. Accordingly, while the engine is in operation, the throttle opening degree (the flow rate of the intake air), the amount of fuel injection and the like are controlled to respective target values.

When the ignition switch is turned off, engine control operations including the above controls of the throttle opening degree, the ignition control and the fuel injection control are forcibly terminated.

The ECU is connected to a crank angle sensor, an accelerator opening degree sensor, and the throttle opening degree sensor. The ECU is further connected to a coolant temperature sensor, an intake air temperature sensor, an air flow meter, and an intake air pressure sensor, and the like. Sensor signals from the above sensors are sent to the microcomputer of the ECU after being converted through A/D converters.

The crank angle sensor, the accelerator opening degree sensor, the throttle opening degree sensor, the coolant temperature sensor, the intake air temperature sensor, the air flow meter, and the intake air pressure sensor and the like constitute operation condition detection means for detecting an operation condition of the engine.

The ECU performs a feedback control of the power supply to the coil of the motor so as to reduce a deviation between an accelerator opening degree signal outputted from the accelerator opening degree sensor and a throttle opening degree signal outputted from the throttle opening degree sensor.

Next, a structure of the throttle body 2 of the present embodiment will be described in detail with reference to FIGS. 1 and 2.

The outer tube 4 and the inner tube 3 provide an annular space between them. The throttle body 2 has a separator 20 to separate the annular space into a first annular space 21 and a second annular space 22. The separator 20 has an annular shape and directly connects an inner surface of the outer tube 4 and an outer surface of the inner tube 3. The separator 20 is disposed at a location corresponding to a substantially middle of the inner tube 3 with respect to an axial direction of the inner tube 3, that is, between the first and second throttle bores 13, 14. The separator 20 is located on a plane perpendicular to the axes of the first and second throttle bores 13, 14 and the passing through the axis of the shaft 6. The separator 20 extends over an outer circumference of the inner tube 3.

The first annular space 21 is provided above the separator 20, and the second annular space 22 is provided under the separator 20. The first annular space 21 serves as a liquid storage portion, such as a liquid storage groove, for storing liquid, such as water, condensate and the like, therein.

The bottom wall of the liquid storage portion 21, that is, an upper wail of the separator 20 is perpendicular to the axes of the first and second throttle bores 13, 14. That is, the bottom wall of the liquid storage portion 21 is not inclined relative to the horizontal direction of the vehicle, such as a vehicle front and rear direction and a vehicle right and left direction. The liquid storage portion 21 is open in an upward direction. Water flowing along the surface of the outer tube 4 can easily flow in the liquid storage portion 21. The liquid storage portion 21 has a predetermined content volume to store liquid, such as water flowing from an upper location of the outer tube 4 therein.

The lower wall of the separator 20 provides an upper end of the second annular space 22. The lower wall of the separator 20 is perpendicular to the axes of the first and second throttle bodes 13, 14. That is, the lower wall of the separator 20 is not inclined relative to the horizontal direction. The second annular space 22 is open in a downward direction.

The inner tube 3 includes two first arcuate walls 31, two first projecting walls 32, two second arcuate walls 33 and two second projecting walls 34. The first arcuate walls 31 are configured to regulate a level of the liquid stored in the liquid storage portion 21. The first projecting walls 32 project higher than the upper edges of the first arcuate walls 31. That is, upper edges of the first projecting walls 32 are located higher than the upper edges of the first arcuate walls 31. The second arcuate walls 33 are disposed to be symmetric with the first arcuate walls 31 in the axial direction of the throttle body 2. The second projecting walls 34 project lower than the lower edges of the second arcuate walls 33. That is, lower edges of the second projecting walls 34 are located lower than the lower edges of the second arcuate walls 33.

The first arcuate walls 31 constitute a part of the inner tube 3. The upper edges of the first arcuate walls 31 serve as overflow portions to allow the water to overflow from the liquid storage portion 21 through the upper edge surfaces thereof. Thus, the first arcuate walls 31 can be also referred to as the overflow walls.

The overflow walls 31 are located higher then the separator 20. The overflow walls 31 are offset from locations right above the shaft bearing portions 8 and the bearings 9 by predetermined distances in the circumferential direction. For example, the overflow walls 31 are separated from the locations right above the shaft bearing portions 8 and the bearings 9 by predetermined angles, such as in a range between 45 degrees and 60 degrees, in the circumferential direction.

For example, the upper edge surfaces of the overflow walls 31 are perpendicular to the up and down direction, that is, perpendicular to the axis of the throttle body 2.

The first projecting walls 32 are respectively located to correspond to the shaft bearing portions 8 and the bearings 9 with respect to the circumferential direction. The first projecting walls 32 are located in predetermined areas right above the shaft bearing portions 8 and the bearings 9. The first projecting walls 32 serve as overflow-restricting walls or overflow-restricting portions for restricting the liquid stored in the liquid storage portion 21 from overflowing from upper edges thereof. That is, the first projecting walls 32 restrict the liquid from overflowing from locations above the shaft bearing portions 8 and the bearings 9 shown by a dashed line L1 in FIG. 2.

Each of the first projecting walls 32 has an arcuate shape, and extends in a predetermined circumferential area that begins from the location right above the shaft bearing portion 8 and the bearing 9 (i.e., dashed line L2 in FIG. 2 passing through the shaft bearing portion 8 in the axial direction) at least in one circumferential direction. In the present embodiment, the first projecting wall 32 extends from the location right above the shaft bearing portion 8 and the bearing 9 in opposite circumferential directions. That is, the first projecting wall 32 is disposed in the predetermined circumferential range including the location right above the shaft bearing portion 8 and the bearing 9.

The inner tube 3 has guide ribs 35 on its inner surface defining the intake air passage for restricting the liquid overflowing from the upper edge surfaces of the two overflow walls 31 or from the upper edge surface of at least one overflow wall 31 from flowing toward the shaft bearing portions 8 and the bearings 9.

For example, the inner tube 3 has four guide ribs 35. The guide ribs 35 are disposed at locations corresponding to opposite sides of the overflow walls 31, that is, base portions of the first projecting walls 32, with respect to the circumferential direction.

The guide ribs 35 project from the inner surface of the inner tube 3 in a radially inward direction. The guide ribs 35 provide predetermined clearances with an edge surface of the circular plate portion of the throttle valve 5. The guide ribs 35 extend straight in the axial direction of the throttle body 2. The guide ribs 35 extend from the vicinities of the upper edge surfaces of the overflow walls 31, that is, adjacent to the highest water level of the liquid storage portion 21 and end at the vicinities of the bottom wall of the liquid storage portion 21. That is, the lower ends of the guide ribs 35 are separated from the shaft bearing portions 8 and the bearings 9 in the axial direction.

Next, an operation of the electronic throttle device of the present invention will be described with reference to FIGS. 1 and 2.

When an engine key switch, that is, the ignition switch is turned on, the ECU controls the power supply to the motor of the electronic throttle device and drives the ignition device and the fuel injection device. As such, an operation of the engine is started.

When the gas pedal is operated, the accelerator opening degree signal detected by the accelerator opening degree sensor is inputted to the ECU. Thus, the ECU controls the power supply to the motor so as to rotate the output shaft of the motor such that the throttle valve 5 is operated to a predetermined throttle opening degree (rotational degree). As such, the shaft 6 connected to the motor is rotated against the biasing force of the return spring by a predetermined rotational angle in accordance with the degree of operation of the gas pedal.

Accordingly, the throttle valve 5 held by the shaft 6 is moved in the valve opening direction, that is, from the fully closed position toward the fully open position.

When the specific engine cylinder is shifted from an exhaust stroke to an intake stroke in which the intake valve is opened and the piston is descended, the negative pressure of the combustion chamber of the engine cylinder is increased in accordance with the descending of the piston, and thus the mixed gas is suctioned into the combustion chamber from the opened intake port. The negative pressure is lower than atmospheric pressure. At this time, the intake air passage, that is, the throttle bores 13, 14 of the throttle body 2 is opened in accordance with the throttle opening degree of the throttle valve 5. Therefore, the engine rotation speed is varied to the speed corresponding to the operation degree of the gas pedal.

Next, effects of the present embodiment will be described. In the electronic throttle device mounted in the down-draft manner, the throttle body 2 is connected to the lower end of the air cleaner hose 1, and has the liquid storage portion 21 having an annular groove shape between the outer tube 4 and the inner tube 3. The liquid storage portion 21 is open in the upward direction. The liquid storage portion 21 has the predetermined content volume and is thus capable of storing a predetermined volume of liquid therein. Therefore, liquid content (e.g., water content) in the intake air to be suctioned into the combustion chambers of the engine and liquid (e.g., water) entering the intake duct from the outside of the intake duct can be easily stored in the liquid storage portion 21.

For example, the liquid entering the intake duct from the outside of the intake duct may be rain, washing water when the vehicle is washed, splash water caused when the vehicle runs over wet road or puddles, and the like.

In a case where the electronic throttle device is mounted in a vehicle having a crankcase emission control system (PCV system), the throttle body 2 is arranged under an opening of a PCV port, for example. In the crankcase emission control system, blowby gas (hereinafter, referred to as PCV gas) flowing in a crankcase from a clearance between the engine cylinder and the piston is returned to an intake air system of the engine to be re-combusted without being released to the atmosphere, In general, the PCV gas contains an amount of water content. If the PCV port is cold, the water content in the PCV gas is condensed, and thus condensate is generated. The condensate is likely to drop in the throttle body 2 from an opening of the PCV port.

In a case where the throttle device is mounted in a vehicle having an exhaust gas recirculation system (EGR system) for returning a part of the exhaust gas (hereinafter, referred to as the EGR gas) discharged from the combustion chambers of the engine to the intake air system of the engine, because the EGR gas contains an amount of water content, condensate of such water content is likely to enter the throttle body 2.

If the water content is condensed in the intake air duct including the air cleaner hose 1 upstream of the throttle body 2, drops of the condensate will enter the throttle body 2.

In the throttle body 2, the liquid, such as water content, condensate, and the like, stored in the liquid storage portion 21 overflows from the upper end of the inner tube 3, However, if the overflowed liquid flows toward the ends of the shaft 6, it will enter the shaft bearing portions 8 and the bearings 9. As a result, the throttle valve 5 and the shaft 6 may be iced.

In the present embodiment, therefore, the inner tube 3 includes the two first projecting walls 32 projecting higher than the upper edge surfaces of the two overflow walls 31. Each of the first projecting walls 32, for example, has a trapezoidal shape. The first projecting wall 32 is disposed in the predetermined circumferential range including the location right above the shaft bearing portion 8 and the bearing 9. That is, the upper end of the inner tube 3 is projected upward at the locations right above the shaft bearing portions 8 and the bearings 9.

Accordingly, in the throttle device mounted in the down-draft manner, the liquid stored in the liquid storage portion 21 always overflows from the upper edge surface of the overflow walls 31, which are lower than the first projecting walls 32. It is less likely that the liquid stored in the liquid storage portions 21 will not overflow from the locations right above the shaft bearing portions 8 and the bearings 9, that is, from the location shown by the dashed line L1 in FIG. 2.

The inner tube 3 of the throttle body 2 has the guide ribs 35 on its inner surface to restrict the water overflowing from the liquid storage portion 21 along the upper edge surfaces of the overflow walls 31 from flowing toward the shaft bearing portions 8 and the bearings 9. Namely, the guide ribs 35 are provided between the inner tube 3 and the side surface of the throttle valve 5, at locations adjacent to overflowing points of the liquid storage portion 21. The flow of the liquid can be controlled by the guide ribs 35, and thus it is less likely that the liquid overflowing from the liquid storage portion 21 will reach the shaft bearing portions 8 and the bearings 9.

The portions of the upper end of the inner tube 3 are higher than the upper ends of the overflow walls 31, the portions corresponding to the locations right above the shaft bearing portions 8 and the shaft 6. Such a structure of the inner tube 3 restricts the liquid stored in the liquid storage portion 21 from flowing toward the shaft bearing portions 8 and the bearings 9 and entering the clearance between the shaft bearing portions 8, the shaft 6 and the bearings 9. Accordingly, it is less likely that the throttle valve 5 and the shaft 6 will be iced. Further, malfunctions of the throttle valve 5, such as valve lock, due to the icing of the throttle valve 5 and the shaft 6 can be reduced.

The predetermined clearances are provided between the guide ribs 35 and the edge surface of the circular plate portion of the throttle valve 5 to restrict the throttle valve 5 from interfering with the guide ribs 35 when the throttle valve 5 is operated. Accordingly, malfunction of the throttle valve 5 due to the interference with the guide ribs 35 is reduced.

In addition, the throttle body 2 can be mounted in the engine compartment of the vehicle in the down-draft manner without paying attention to a fixing angle relative to a fixing portion such as the surge tank too much. As such, mountability of the throttle body 2 improves.

The liquid storage portion 21 has the horizontal bottom wall. For example, the bottom wall is a flat surface and extends perpendicular to the axis of the throttle body 2. The upper edge surfaces of the overflow walls 31 are perpendicular to the axis of the throttle body 2. For example, the upper edge surfaces of the overflow walls 31 are flat surfaces extending perpendicular to the axis of the throttle body 2. That is, the inner tube 3 and the liquid storage portion 21 are not inclined relative to the horizontal direction of the vehicle. Further, the upper edge surfaces of the overflow walls 31 are not inclined. Therefore, the volume of the liquid stored in the liquid storage portion 21 increases. That is, the liquid can be stored by fully utilizing the space provided between the outer tube 4 and the inner tube 3 with the height of the overflow walls 31.

Second Embodiment

Figure 3:
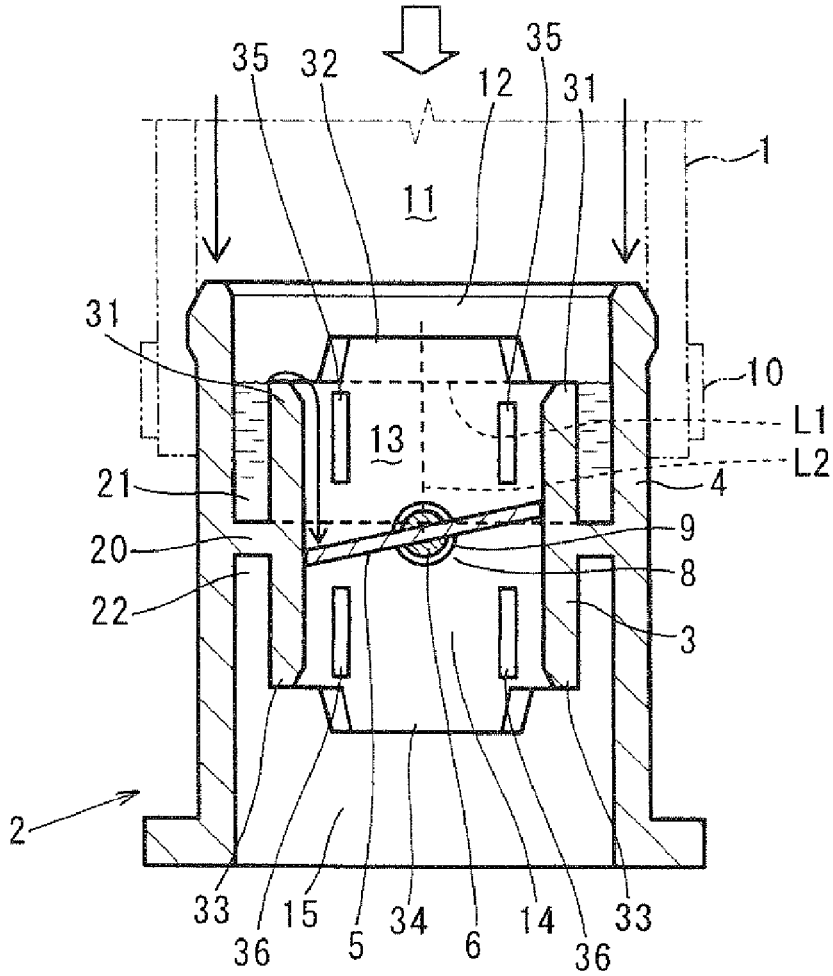
FIG. 3 is a cross-sectional view of a throttle body an electronic throttle device for an internal combustion engine according to a second aspect of the present invention.

A second embodiment of the present invention will be described with reference to FIG. 3. In the present embodiment, the throttle body 2 has guide ribs 36 on the inner surface of the second arcuate walls 33, in addition to the guide ribs 35 of the overflow walls 31. That is, the inner tube 3 including the first arcuate walls 31, the first projecting walls 32, the second arcuate walls 33, the second projecting ribs 34 and the guide ribs 35, 36 has a symmetrical shape with respect to the plane passing through the separator 20.

The throttle device can be mounted in a reverse manner In such a case, the second annular space 22 serves as the liquid storage portion, similar to the liquid storage portion 21 of the first embodiment. Also, the inner tube 3 has the second projecting walls 34. The second projecting walls 34 can serve as the overflow restricting walls, similar to the first projecting wall 32 of the first embodiment. Further, the guide ribs 36 can serve in the similar manner as the first guide ribs 35 of the first embodiment. Accordingly, the similar effects as the first embodiment can be achieved.

Further, the throttle device can be mounted in the up-draft manner such that the intake air flows through the first and second throttle bores 13, 14 in the upward manner. In such a case, the similar effects can be achieved (Modifications)

Use of the valve unit of the above embodiments is not limited to the throttle device for controlling the flow rate of the intake air to be suctioned into the combustion chambers of the engine. For example, the valve unit can be used as an intake air flow control device that generates intake vortex flow for facilitating combustion of the air-fuel mixture in the combustion chambers. Further, the valve unit can be used as an intake passage control device that controls the intake air passage of the engine.

Furthermore, the valve unit is not limited to the intake device for the engine, but can be used for controlling a gas passage in association with the engine.

In the above embodiments, the actuator for driving the shaft 6 and the throttle valve 5 is constructed of the electric actuator including the motor and the driving force transmitting device. However the actuator is not limited to the above. For example, the actuator can be constructed of any other-types of actuators, such as a negative pressure actuator including an electromagnetic negative pressure control valve or an electric negative pressure control valve.

Further, the intake device of the above embodiments can be employed to a throttle device in which the throttle valve 5 is operated by mechanically transmitting the operation amount of the gas pedal to the shaft 6 through a wire and the like.

The engine is not limited to the gasoline engine, but can be diesel engine. Further, the engine is not limited to the multiple cylinder engine, but can be a single cylinder engine.

In the above embodiments, the throttle body 2 is connected to the air cleaner case through the air cleaner hose 1. However, the connection may be modified. For example, the throttle body 2 can be connected to the air cleaner case through an intake duct.

Figure 4:
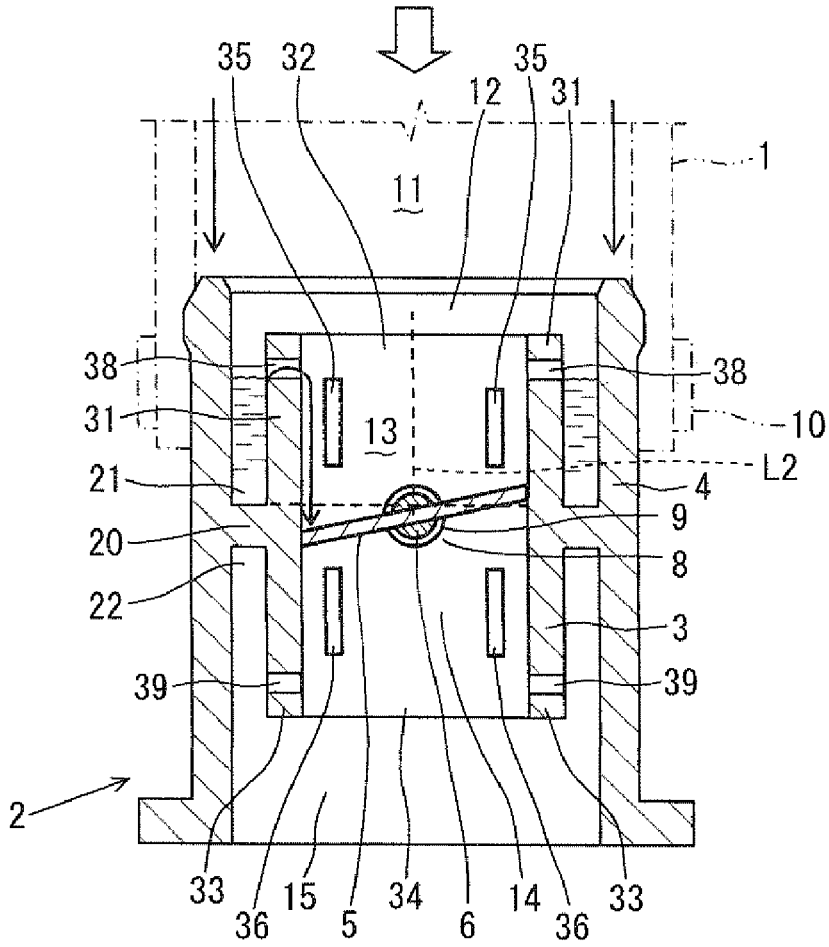
FIG. 4 is a cross-sectional view of a throttle body of an electronic throttle device for an internal combustion engine according to further another embodiment of the present invention.
Figure 5:
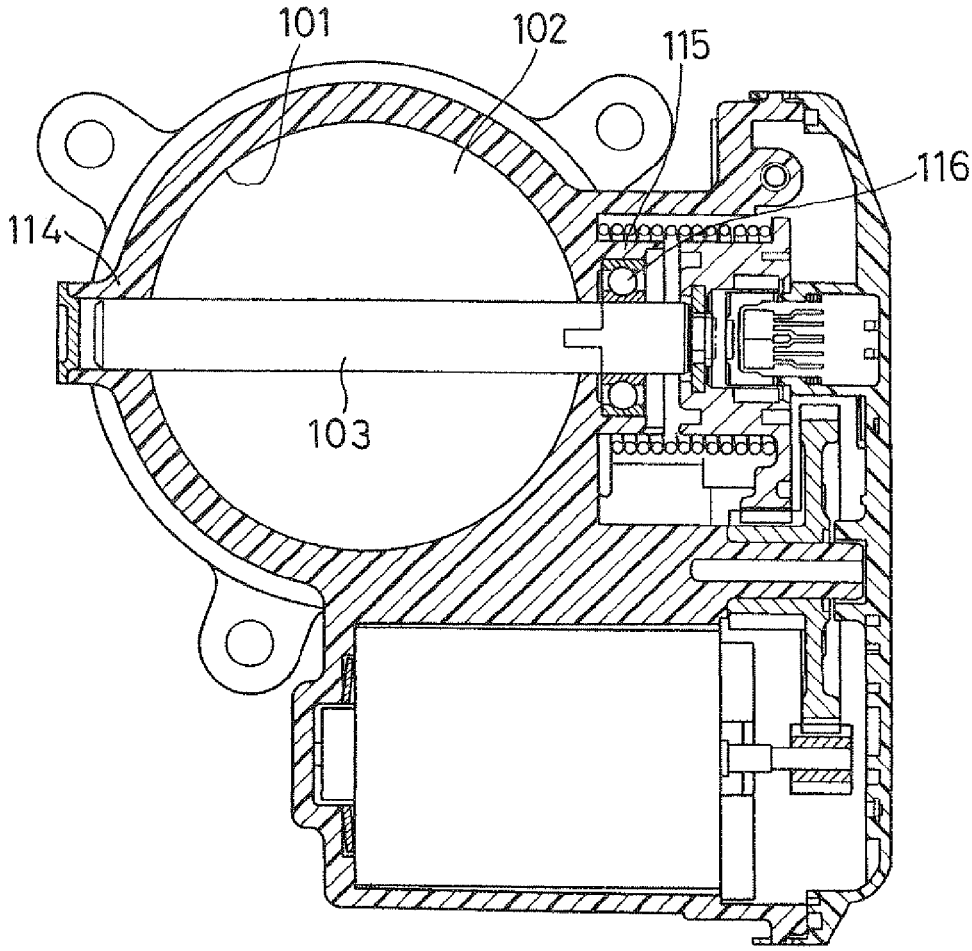
FIG. 5 RELATED ART
FIG. 5 is a cross-sectional view of an electronic throttle device for an internal combustion engine according to a related art.
Figure 6:
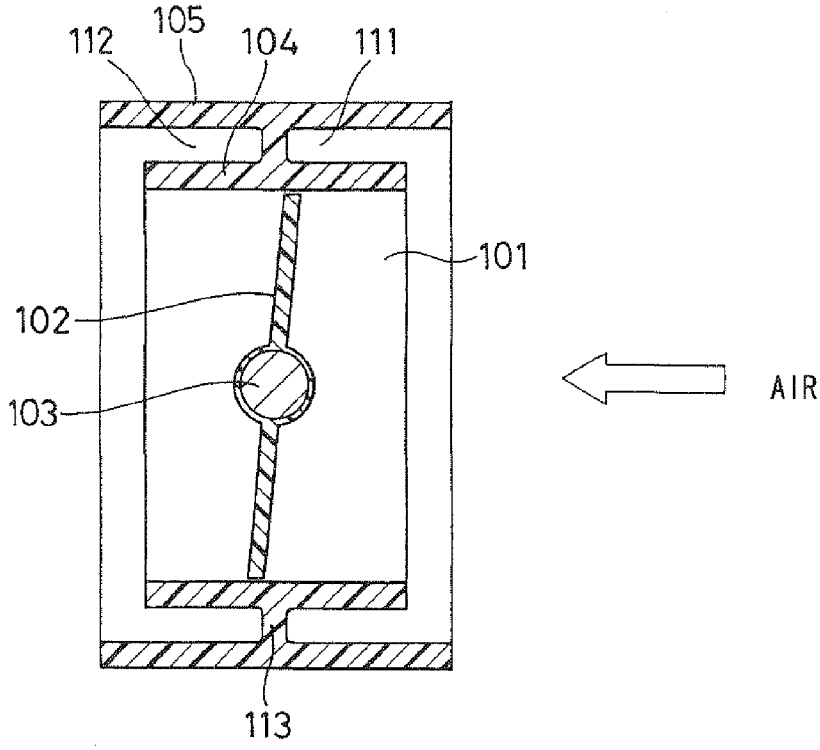
FIG. 6 RELATED ART
FIG. 6 is a cross-sectional view of a throttle body of the electronic throttle device according to the related art.
Figure 7:
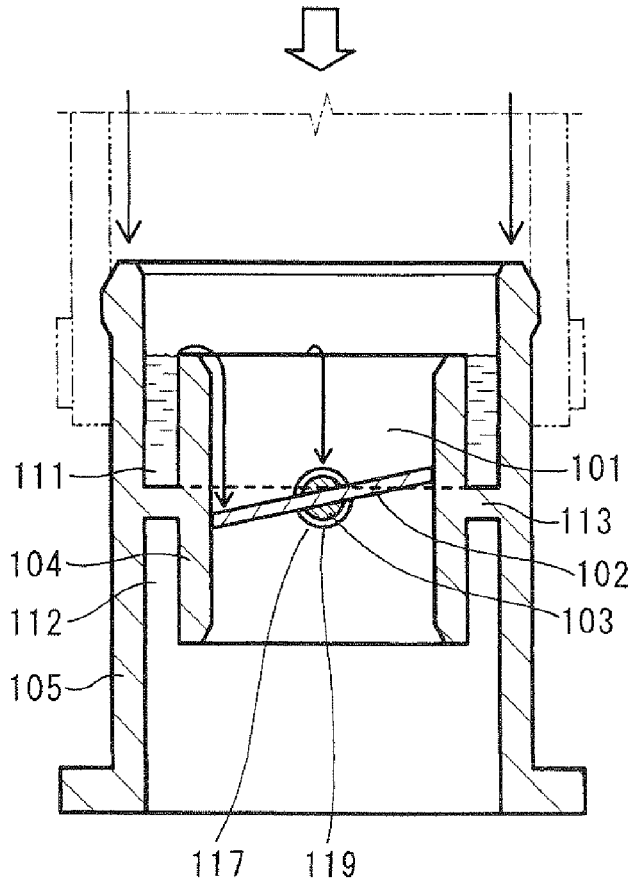
FIG. 7 RELATED ART
FIG. 7 is a cross-sectional view of a throttle body of an electronic throttle device for an internal combustion engine according to another related art.
Figure 8:
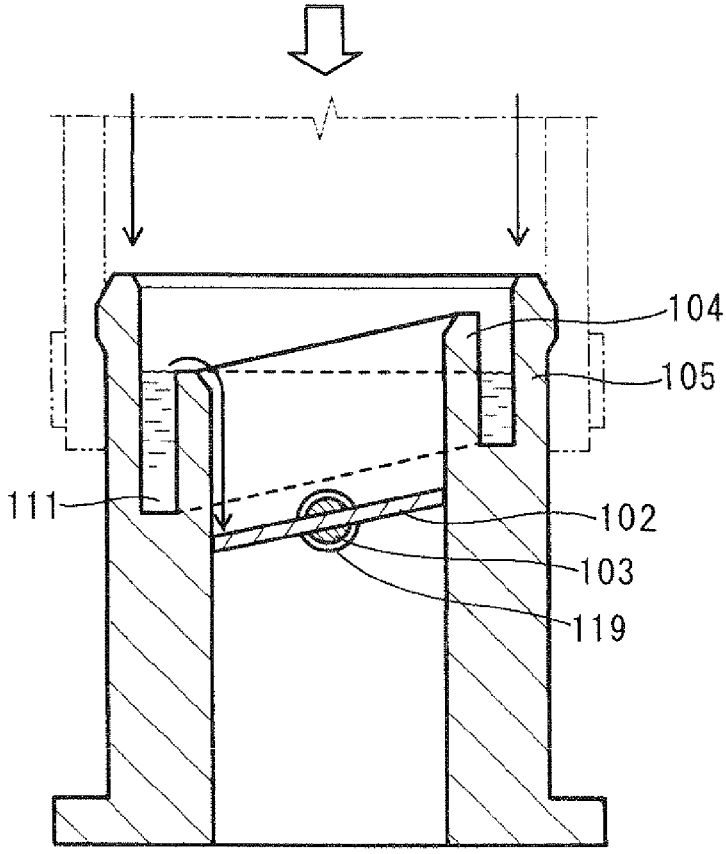
FIG. 8 RELATED ART
FIG. 8 is a cross-sectional view of a throttle body of an electronic throttle device for an internal combustion engine according to further another related art.

In the above embodiments, the overflow portions are provided by the upper edge surfaces of the overflow walls 31. However, the structure of the overflow portions can be modified. For example, the overflow portions can be provided by V-shaped slit formed between the two projecting walls 32, 34 arranged in the circumferential direction. Alternatively, the overflow portions can be provided by overflow holes 38 (i.e., an opening, through hole) formed in the inner tube 3 for allowing communication between the liquid storage portion 21 and the throttle bores 13, 14, as shown in FIG. 4.

The overflow hole 38 is configured to regulate the level of the liquid stored in the liquid storage portion 21. The overflow hole 38 is formed at a location other than the predetermined area in which the overflow-restricting portions 32, 34 are formed, In such a case, it is not always necessary that the overflow restricting portions 32, 34 are provided by the projecting walls. Also, the inner tube 3 can additionally have second overflow holes 39 to be symmetric with the overflow holes 38.

In the above embodiments, circumferential side surfaces of the first and second projecting walls 32, 34 are inclined such that the first and second projecting walls 32, 34 are tapered. However, the shape of the first and second projecting walls 32, 34 can be modified. For example, both of or one of the circumferential side surfaces of each projecting wall 32, 34 can be a straight surface parallel to the axis of the throttle body 2 or a curved surface.

Further, if the throttle device is used only as the down-draft throttle device, it is not always necessary to have the second annular space 22, the second arcuate walls 33 and the second projecting walls 34.

Additional advantages and modifications will readily occur to those skilled in the art. The invention in its broader term is therefore not limited to the specific details, representative apparatus, and illustrative examples shown and described.

What is claimed is:

1. A valve unit for an internal combustion engine, comprising:

a duct including an inner tube defining a gas passage therein and an outer tube disposed radially outside of the inner tube, the duct providing an annular liquid storage groove between the inner tube and the outer tube, the duct having a bearing portion, the inner tube defining an axis in an up and down direction;

a valve disposed in the inner tube, the valve being operable to control the gas passage; and a shaft supporting the valve and held through the bearing portion of the duct, wherein the inner tube includes an overflow portion and an overflow-restricting portion at an upper end thereof, the overflow portion being configured to regulate a level of liquid stored in the liquid storage groove and allow excess liquid to overflow from the liquid storage groove, the overflow-restricting portion being provided in a predetermined area above the bearing portion and located higher than the overflow portion with respect to an axial direction of the inner tube to restrict the liquid stored in the liquid storage groove from overflowing from the predetermined area above the bearing portion.

2. The valve unit according to claim 1, wherein the overflow-restricting portion is provided by a projecting wall projecting higher than the overflow portion.

3. The valve unit according to claim 1, wherein the predetermined area begins from a location right above the bearing portion and extends in at least in one circumferential direction of the inner tube.

4. The valve unit according to claim 1, wherein the overflow portion is separated from a location right above the bearing portion by a predetermined distance in a circumferential direction of the inner tube.

5. The valve unit according to claim 1, wherein the overflow portion is provided by a part of an upper edge surface of the inner tube, the part being lower than another part of the upper edge surface defining the overflow-restricting portion.

6. The valve unit according to claim 1, wherein the overflow portion is provided by an overflow hole passing through a wall of the inner tube from the liquid storage groove to the gas passage.

7. The valve unit according to claim 1, wherein the liquid storage groove has a bottom wall that is perpendicular to the axis of the inner tube.

8. The valve unit according to claim 1, wherein the liquid storage groove is open in an upward direction.

9. The valve unit according to claim 1, wherein the liquid storage groove has a predetermined content volume capable of storing a predetermined volume of liquid therein.

10. The valve unit according to claim 1, wherein the inner tube has a guide rib on its inner surface defining the gas passage, and the guide rib is configured to restrict the liquid overflowing from the overflow portion from flowing toward the bearing portion.

11. The valve unit according to claim 10, wherein the guide rib projects from the inner surface of the inner tube in a radially inward direction.

12. The valve unit according to claim 10, wherein the guide rib is configured such that a predetermined clearance is provided between its surface and the valve.

13. The valve unit according to claim 10, wherein the guide rib extends parallel to the axis of the inner tube.

14. The valve unit according to claim 10, wherein the inner tube has a plurality of guide ribs including the guide rib, and the plurality of guide ribs are located higher than the bearing portion and on opposite sides of the bearing portion in a circumferential direction.

15. The valve unit according to claim 1, wherein the duct has a separator between the outer tube and the inner tube to separate a annular space between the outer tube and the inner tube into the liquid storage groove and another annular groove in the axial direction, the inner tube has the overflow portion and the overflow-restricting portion at each of the upper end and a lower end thereof, and the inner tube has a symmetrical shape with respect to the axial direction.

16. The valve unit according to claim 15, wherein the duct has a first guide rib and a second guide rib on an inner surface of the inner tube, the first and second guide ribs are configured to restrict the liquid overflowing from the overflow portion from flowing toward the bearing portion, and the first guide rib is located higher than the shaft and the second guide rib is located lower than the shaft.

17. The valve unit according to claim 1, wherein the gas passage is an intake air passage through which intake air to be introduced in a combustion chamber of the internal combustion engine flows.

* * * * *